US010460549B2

(12) United States Patent
Wegelin

(10) Patent No.: US 10,460,549 B2
(45) Date of Patent: Oct. 29, 2019

(54) SYSTEMS AND METHODS FOR DEVICE USAGE MONITORING

(71) Applicant: GOJO Industries, Inc., Akron, OH (US)

(72) Inventor: Jackson Wegelin, Stow, OH (US)

(73) Assignee: GOJO Industries, Inc., Akron, OH (US)

( * ) Notice: Subject to any disclaimer, the term of this patent is extended or adjusted under 35 U.S.C. 154(b) by 152 days.

(21) Appl. No.: 15/245,325

(22) Filed: Aug. 24, 2016

(65) Prior Publication Data

US 2017/0061726 A1 Mar. 2, 2017

Related U.S. Application Data

(60) Provisional application No. 62/211,253, filed on Aug. 28, 2015.

(51) Int. Cl.

| | |
|---|---|
| ***A47K 5/06*** | (2006.01) |
| ***G07F 13/00*** | (2006.01) |
| ***G08B 21/24*** | (2006.01) |

(52) U.S. Cl.

CPC ..... *G07F 13/00* (2013.01); *A47K 5/06* (2013.01); *G08B 21/245* (2013.01)

(58) Field of Classification Search

CPC ..... G06K 17/00

See application file for complete search history.

(56) References Cited

U.S. PATENT DOCUMENTS

| | | | | |
|---|---|---|---|---|
| 8,159,349 | B2 * | 4/2012 | McAllister | B65C 9/1865 340/10.51 |
| 9,007,936 | B2 | 4/2015 | Gaylard | |
| 9,830,764 | B1 * | 11/2017 | Murphy | G07F 11/002 |

(Continued)

FOREIGN PATENT DOCUMENTS

| | | |
|---|---|---|
| WO | 2010/141689 A2 | 12/2010 |
| WO | 2013/0055616 A2 | 4/2013 |

OTHER PUBLICATIONS

Anton Pleteraa EK et al., "Monitoring, Control and Diagnostics using RFID Infrastructure", Journal of Medical Systems, Kluwer Academic Publishers—Plenum Publishers, NE, vol. 36, No. 6, Mar. 22, 2012, pp. 3733-3739, XP035118438.

*Primary Examiner* — Timothy R Waggoner
(74) *Attorney, Agent, or Firm* — Calfee, Halter & Griswold LLP

(57) ABSTRACT

In an exemplary method of monitoring usage of an electronically operated dispenser, a dispensing mechanism is operated by an internal controller of the dispenser in response to user activation of an actuator of the dispenser in communication with the controller. In response to operation of the dispensing mechanism, dispenser data is written to an internal dispenser memory in wired communication with the controller, with the controller and the dispenser memory being electrically connected with and powered by a power source. The dispenser memory receives a wireless interrogation signal from an external reader and collects energy from the wireless interrogation signal. In response to receipt of the wireless interrogation signal, the dispenser memory wirelessly transmits the written dispenser data to the external reader, with the dispenser memory being powered by the collected energy.

20 Claims, 3 Drawing Sheets

(56) References Cited

U.S. PATENT DOCUMENTS

| | | | | |
|---|---|---|---|---|
| 2004/0090333 | A1* | 5/2004 | Wildman | G06F 19/3418 340/573.1 |
| 2008/0100441 | A1* | 5/2008 | Prodanovich | B08B 3/04 340/572.1 |
| 2010/0230435 | A1* | 9/2010 | Wegelin | A47K 5/1217 222/52 |
| 2011/0121974 | A1* | 5/2011 | Tenarvitz | G08B 21/245 340/573.1 |
| 2012/0062382 | A1* | 3/2012 | Taneff | G08B 21/245 340/573.1 |
| 2013/0015956 | A1* | 1/2013 | Wegelin | G07C 1/10 340/10.1 |
| 2015/0022361 | A1 | 1/2015 | Gaisser et al. | |
| 2015/0203297 | A1* | 7/2015 | Manning | F25D 13/06 700/218 |

* cited by examiner

SYSTEMS AND METHODS FOR DEVICE USAGE MONITORING

RELATED APPLICATIONS

This application claims priority to and the benefits of U.S. Provisional Patent Application Ser. No. 62/211,253 filed on Aug. 28, 2015 and entitled "SYSTEMS AND METHODS FOR DEVICE USAGE MONITORING," which is incorporated herein by reference in its entirety.

BACKGROUND

Procedures relying on unsupervised self-directed compliance of many individuals may be vulnerable to noncompliance, particularly where such noncompliance is not easily detectable after the fact. For example, hand hygiene procedures in hospitals and other healthcare settings, intended to prevent the spread of bacteria, viruses, and other disease-causing microorganisms, are often vulnerable to non-compliance. Typical hand hygiene procedures include conventional soap and water hand washing, and the use of antibacterial fluids, such as gels or foams, which has the advantage of not requiring rinsing of the hands. These procedures, while effective, are not easily and/or cost effectively verified after the fact.

SUMMARY

Exemplary embodiments of usage monitoring devices, systems, and methods are described herein. In an exemplary method of monitoring usage of an electronically operated dispenser, a dispensing mechanism is operated by an internal controller of the dispenser in response to user activation of an actuator of the dispenser in communication with the controller. In response to operation of the dispensing mechanism, dispenser data is written to an internal dispenser memory in circuit communication with the controller, with the controller and the dispenser memory being electrically connected with and powered by a power source. The dispenser memory receives a wireless interrogation signal from an external reader and collects energy from the wireless interrogation signal. In response to receipt of the wireless interrogation signal, the dispenser memory wirelessly transmits the written dispenser data to the external reader, with the dispenser memory being powered by the collected energy.

In another exemplary embodiment, an electronically operated dispenser includes an actuator, a dispensing mechanism, a controller, and a dispenser memory. The actuator is in communication with the controller, which is configured to operate the dispensing mechanism in response to user activation of the actuator. The dispenser memory may be in circuit communication with a wired interface and a wireless interface. The wired interface supports wired communication between the dispenser memory and the controller, and powered by a power source electrically connected with the controller and the dispenser memory, for writing dispenser data from the controller to the dispenser memory. The wireless interface supports passive wireless communication between the dispenser memory (and any required circuitry) and an external reader, for transmitting the written dispenser data from the dispenser memory to the external reader, the dispenser data transmission being powered by energy collected from a wireless interrogation signal received by the dispenser memory.

In yet another exemplary embodiment, a hand hygiene monitoring system includes an electronically operated dispenser and an external reader. The electronically operable dispenser includes an actuator, a dispensing mechanism, a controller, and a dispenser memory. The actuator is in communication with the controller, which is configured to operate the dispensing mechanism in response to user activation of the actuator. The dispenser memory may include a wired interface and a wireless interface. The wired interface supports wired communication between the dispenser memory and the controller, and is powered by a power source electrically connected with the controller and the dispenser memory, for writing dispenser data from the controller to the dispenser memory. The external reader is configured to wirelessly transmit an interrogation signal to the wireless interface, with the dispenser memory (and any associated required circuitry) collecting energy from the interrogation signal to power the dispenser memory for transmission of the written dispenser data to the external reader.

BRIEF DESCRIPTION OF THE DRAWINGS

These and other features and advantages of the present invention will become better understood with regard to the following description and accompanying drawings in which.

DETAILED DESCRIPTION

Figure 1:
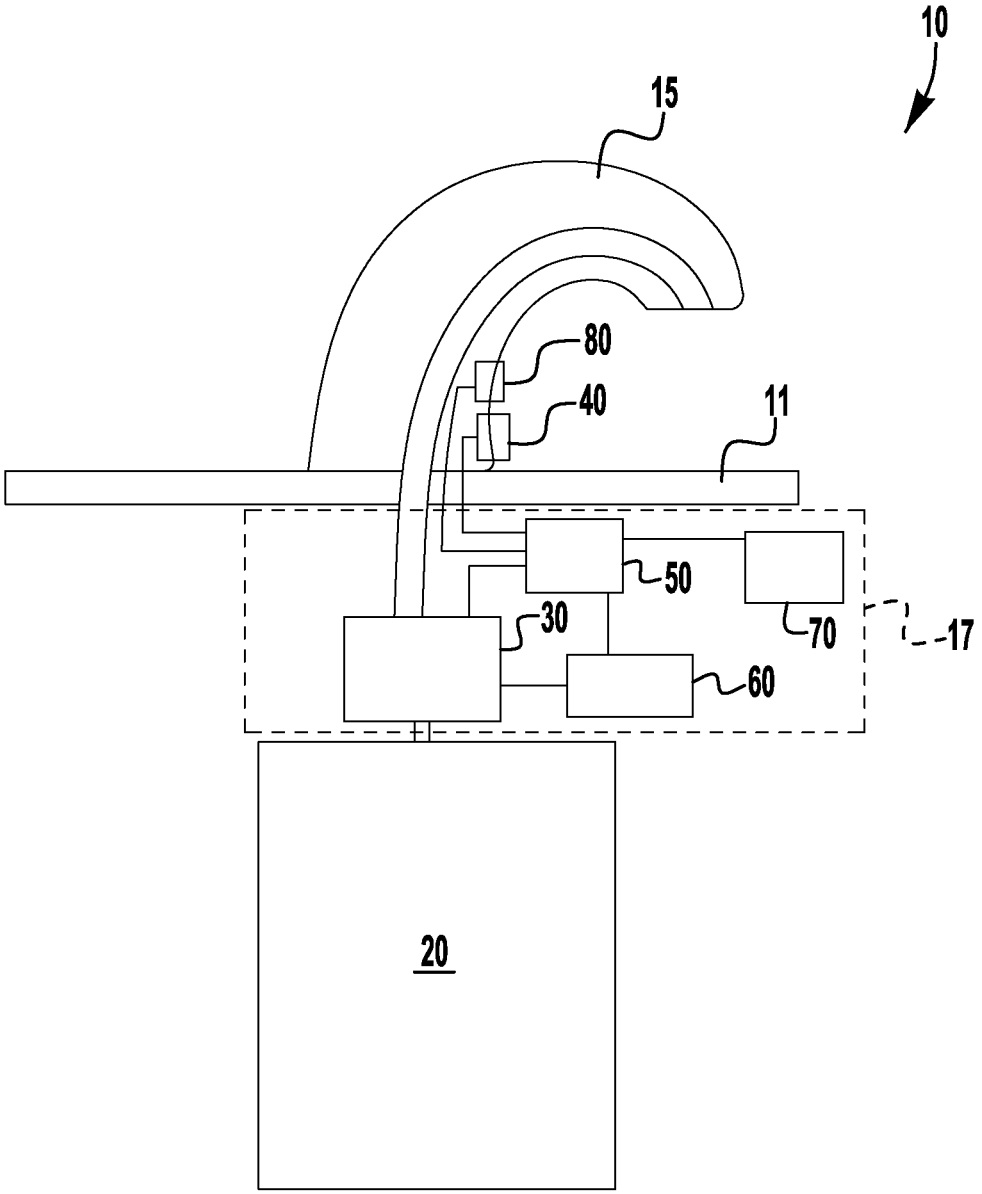
FIG. 1 is a schematic view of an electronically operated dispenser, according to an exemplary embodiment.

The Detailed Description merely describes exemplary embodiments of the invention and is not intended to limit the scope of the claims in any way. Indeed, the invention is broader than and unlimited by the exemplary embodiments, and the terms used in the claims have their full ordinary meaning.

Also, while certain exemplary embodiments described in the specification and illustrated in the drawings relate to dispenser devices for hand hygiene applications, and systems and methods for monitoring usage of hand hygiene dispenser devices, it should be understood that many of the inventive features described herein may be applied to other systems and methods. For example, the features described herein may be utilized in systems and/or methods for monitoring conditions and usage of other types of dispensers (e.g., sunscreen, pharmaceuticals) and other types of devices.

"Circuit communication" indicates a communicative relationship between devices. Direct electrical, electromagnetic and optical connections and indirect electrical, electromagnetic and optical connections are examples of circuit communication. Two devices are in circuit communication if a signal from one is received by the other, regardless of whether the signal is modified by some other device. For example, two devices separated by one or more of the following—amplifiers, filters, transformers, optoisolators, digital or analog buffers, analog integrators, other electronic circuitry, fiber optic transceivers or satellites—are in circuit communication if a signal from one is communicated to the other, even though the signal is modified by the intermediate device(s). As another example, an electromagnetic sensor is in circuit communication with a signal if it receives electromagnetic radiation from the signal. As a final example, two devices not directly connected to each other, but both capable of interfacing with a third device, such as, for example, a CPU, are in circuit communication.

"Logic," as used herein, is synonymous with "circuit" or "circuitry" and includes, but is not limited to, hardware, firmware, software and/or combinations of each to perform a function(s) or an action(s). For example, based on a desired application or needs, logic may include a software controlled microprocessor or microcontroller, discrete logic, such as an application specific integrated circuit (ASIC) or other programmed logic device. Logic may also be fully embodied as software. The circuits identified and described herein may have many different configurations to perform the desired functions.

"Signal," includes, but is not limited to one or more electrical signals, analog or digital signals, one or more computer instructions, a bit or bit stream, or the like.

Any values identified in the detailed description are exemplary and they are determined as needed for a particular dispenser and/or refill design. Accordingly, the inventive concepts disclosed and claimed herein are not limited to the particular values or ranges of values used to describe the embodiments disclosed herein.

An exemplary aspect of the present application involves systems and methods for monitoring usage of hand hygiene dispenser devices. In one such embodiment, a hand cleaning fluid dispenser is configured to facilitate system monitoring of dispenser usage.

FIG. 1 schematically illustrates an exemplary hand cleaning fluid dispenser 10. The exemplary dispenser is a countermount dispenser system, however, any type of dispenser may be used, such as, for example, a wall mounted dispenser, a stand mounted dispenser, a standalone dispenser, a tabletop dispenser, or the like. Alternatively, the dispenser may be a portable dispenser, for example, a battery-powered repositionable dispenser or a pocket sized or "personal carriage" dispenser. The exemplary dispenser includes a spout 15, which is mounted to a countertop 11. The dispenser 10 further includes a reservoir 20 for storing a hand cleaning fluid, and a dispensing mechanism 30 (e.g., a pump) for dispensing hand cleaning fluid from the reservoir 20 to the spout 15. For selective operation of the dispensing mechanism 30, the dispenser 10 includes an actuator 40 positioned for user actuation of the dispensing mechanism 30 to supply hand cleaning fluid to one or both hands of the user. The actuator may be disposed on or otherwise carried by the spout, or alternatively, may be remote or spaced apart from the spout, for example, separated by a wired connection.

The actuator 40 may include one or more of a variety of actuating mechanisms. For example, the actuator may include a button, plunger, capacitance sensor, or other contact sensor that is touched or manually depressed by the user to dispense hand cleaning fluid (e.g., depressed by a first hand to dispense hand cleaning fluid into a second hand of the user). As another example, the sensor may include one or more non-contact sensors configured to sense one or more of user movement (e.g., motion sensor), user proximity (e.g., infrared sensor or capacitance sensor), or voice commands (e.g., microphone), such that the user may receive hand cleaning fluid without exposure to surface bacteria (and without the spread of bacteria to such a surface).

The actuator 40 is in circuit communication with a controller 50 of the dispenser 10, for example, by a wired connection, to transmit an activating signal to the controller upon user activation of the actuator. The controller 50 may include a processor, a microprocessor or the like, and any necessary memory or circuitry required to perform the functions described herein. The controller is in circuit communication with the dispensing mechanism 30, for example, by a wired connection, and includes logic and/or circuitry for operating the dispensing mechanism 30 in response to user activation of the actuator 40.

The exemplary dispenser 10 includes a power source 60 for providing power to the dispensing mechanism 30, the actuator 40, the controller 50, and any other components that require power. The power supply 60 may include one or more batteries, and/or a hard wired alternating current (AC) mains power source supplied by connection to an electrical outlet using a power cord. In one such embodiment, an external (e.g., AC mains) power supply provides primary power to the dispenser, and an internal power supply (e.g., batteries) provides back-up power for operating the dispenser in the event of a power outage.

Figure 2:
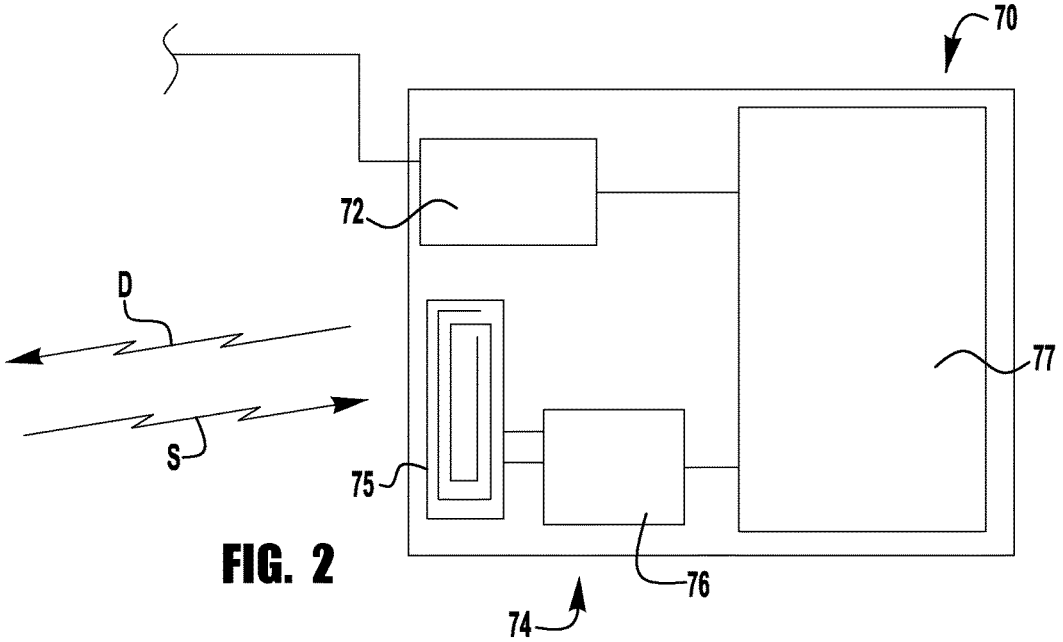
FIG. 2 is a schematic view of the dispenser memory of the dispenser of FIG. 1.

To track usage of the dispenser, the exemplary dispenser 10 includes a dispenser memory 70 powered by the power supply for circuit communication with the controller 50. In the illustrated embodiment, as shown in FIG. 2, the dispenser memory 70 is electrically connected with the controller 50 by a wired interface 72. The dispenser memory 70 receives data signals from the controller 50 communicating dynamic dispenser data corresponding to user actuation of the actuator, including, for example, time, frequency, or duration of use, and stores the data in a memory unit 77. The controller may also communicate dynamic dispenser data corresponding to a current status of the dispenser (e.g., as identified by feedback signals transmitted from the dispensing mechanism 30 to the controller 50), including for example, a non-functioning dispensing mechanism condition, a low battery condition, or a low cleaning fluid condition. In addition to the dynamic dispenser usage data and dispenser condition data, the dispenser memory unit 77 may include static, previously stored (e.g., by the manufacturer) dispenser identification data identifying, for example, the serial number, product number, or location of the dispenser. The dispenser memory may include any suitable volatile or non-volatile memory for storing this dispenser data.

In some embodiments, dispenser data may be retrieved from the dispenser memory using a wired connection, for example, by providing a USB port or other data port on the dispenser, from which the dispenser data may be downloaded, for example, by connection of a portable memory drive. In other embodiments the dispenser may include a wireless interface for wireless communication of the dispenser data to a remote reader, from which this data may be processed or transmitted (e.g., to a further remote or off-site central computer). While the wireless interface may be locally powered (e.g., by an internal battery or AC mains power connection) for active transmission of wireless data signals, in other embodiments, the wireless interface may collect energy from interrogating radio waves to function as a passive transponder transmitting the stored dispenser data.

In the illustrated embodiment of FIG. 2, the wireless interface of the dispenser memory 70 is a passive radio frequency identification (RFID) interface 74 for wirelessly transmitting dispenser data to an external reader. The exemplary RFID interface 74 is powered by RFID interrogation signals S transmitted by the external reader and received by an antenna portion 75 of the RFID interface 74, for collection by a power management portion 76. Additional circuitry known to those skilled in the art may be included to perform the functions described herein. The RFID interface 74 responds to receipt of the interrogation signals S by wirelessly transmitting, using the antenna portion of the RFID interface, dispenser data signals D communicating the dispenser data stored in the dispenser memory unit 77 for receipt by the external reader. The RFID interface may be configured for RF communication at a range of suitable frequencies, including, for example, 13.56 MHz (high frequency or "HF"), as is currently used in Near Field Communication (NFC), or 433 MHz (ultra high frequency or "UHF").

Many different circuitry arrangements may be utilized to provide wired read/write and wireless read/write dispenser memory for a hand hygiene dispenser. In one embodiment, a dual interface electrically erasable programmable read-only memory (EEPROM) unit may be utilized to provide memory having a wired interface including an inter-integrated circuit ($I^2C$) protocol bus for circuit communication between the dispenser memory and the controller, and a wireless RF interface (e.g., antenna and power extraction/power management circuitry) for wireless RF communication between the dispenser memory and an external reader. In an exemplary embodiment, the $I^2C$ bus may be configured for low power (1.8-5.5V) wired communication, and the RF interface may be configured to operate at the 13.56 MHz HF frequency (e.g., in accordance with the ISO/IEC 15693 standard), or the 860-960 MHz UHF frequency range. Commercially available dual interface EEPROM units are offered by NXP Semiconductors and STMicroelectronics.

As shown in FIG. 1, the dispenser may include a housing 17 configured to at least partially enclose and protect one or more of the dispensing mechanism 30, the actuator 40, the controller 50, the power supply 60, and the dispenser memory 70. While the housing may extend from or be integral with the spout, positioned above the countertop (not shown), in the illustrated embodiment, the housing 17 is spaced apart from the spout 15 and positioned below the countertop 11 to further protect these components. In wall mounted dispensers, housing 17 may be integral with the dispenser housing (not shown) or a separate housing within the dispenser housing.

According to another aspect of the present application, existing RFID systems may be adapted or expanded to include one or more hand hygiene dispensers configured for passive wireless communication with an external reader of the existing system. By providing the dispenser with a passive RFID communication circuit, the dispenser can be incorporated into an existing RFID system at a modest incremental cost, without requiring additional FCC approvals (as the passive RFID communication circuit does not include a radio) and without requiring additional regulatory testing. While a reader may include a portable unit (e.g., a smart phone or other handheld device) for mobile auditing of a system of RFID communicating devices (including, for example, hand hygiene dispensers), in other embodiments, a substantially fixed RFID reader is provided with a communication range or read distance to sufficient to collect stored data from passive RFID devices within this read distance, for example for coverage of a fixed zone (e.g., a hospital room, conference room, storeroom, etc.). Commercially available zone-based RFID systems utilizing UHF frequencies in the range of 860-960 MHz for a maximum read distance of 20-30 feet are offered by Odin Technologies, Inc. and Thingmagic, A Division of Trimble.

FIG. 2 schematically illustrates an exemplary system 100 including a hand hygiene dispenser 10, as described in greater detail above, and an external reader 190 positioned within a maximum read distance of the dispenser 10 (e.g., within 30 feet). The dispenser 10 includes a dual interface dispenser memory 70 having a wired interface 72 (e.g., an $I^2C$ serial bus) and a wireless interface 74 (e.g., a passive UHF RFID transceiver). The wired interface 72 is connected with the controller for wired communication of either or both of dynamic dispenser usage data and dynamic dispenser status data from the controller 50 for storage in the dispenser memory 70, along with static dispenser identification data previously written to the memory. The wireless interface 74 includes an antenna portion 75 for collecting electromagnetic energy from interrogation signals S from the reader 90, and a power management portion 76 powered by the collected energy to generate and transmit data signals D communicating the stored dispenser data for receipt by the external reader 190.

Figure 3:
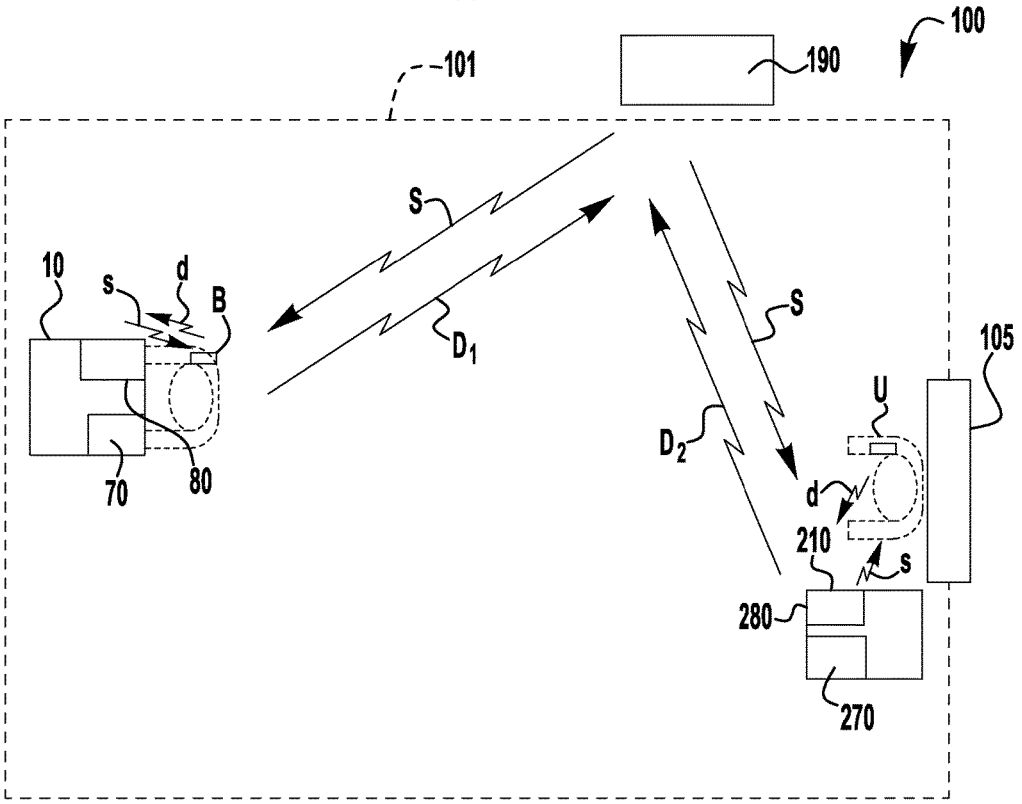
FIG. 3 is a schematic view of a hand hygiene monitoring system including the dispenser of FIG. 1, according to an exemplary embodiment.

In an exemplary hand hygiene dispenser usage monitoring process using the exemplary system of FIG. 3, including the exemplary dispenser 10 of FIG. 2, a user approaches the hand hygiene dispenser 10 and activates the actuator 40, which signals the controller 50 to operate the dispensing mechanism 30, powered by the power source 60, for dispensing hand hygiene fluid to the user (e.g., onto the user's hands). In response to operation of the dispensing mechanism 30, the controller 50, powered by the power source 60, writes dynamic dispenser usage data corresponding to this dispensing operation to the dispenser memory 70 through the wired interface 72, including, for example, the dispense count, the time of the dispensing, and/or the duration of dispensing. The controller 50 may also collect dynamic dispenser status data from the power source 60 (e.g., low battery condition) or the dispensing mechanism 30 (e.g., insufficient power to adequately operate the dispensing mechanism, or insufficient hand hygiene fluid being supplied to the dispensing mechanism). The controller 50, powered by the power source 60, may write this dynamic dispenser status data to the dispenser memory 70 through the wired interface 72, either concurrently with the dynamic dispenser usage data, or in a separate writing operation.

To collect dispenser data from the dispenser 10, an external reader 190 transmits periodic wireless interrogation signals S to the dispenser 10, which is positioned within a read range (e.g., within 30 ft) of the reader 190. The antenna portion 75 of the dispenser's dispenser memory 70 collects energy from the interrogation signals S, and the power management portion 76 of the dispenser memory uses the collected energy to generate RFID signals $D_1$ including both the dynamic dispenser data written to the dispenser memory from the controller 50 and static dispenser identification data (e.g., dispenser serial number or part number) for identifying the dispenser to the reader. The dispenser data signals $D_1$ are transmitted to the reader 190, which may include circuitry and logic for processing the collected data. Alternatively, the reader may be configured to transmit the collected data to a remote computer system for further processing.

Figure 4:
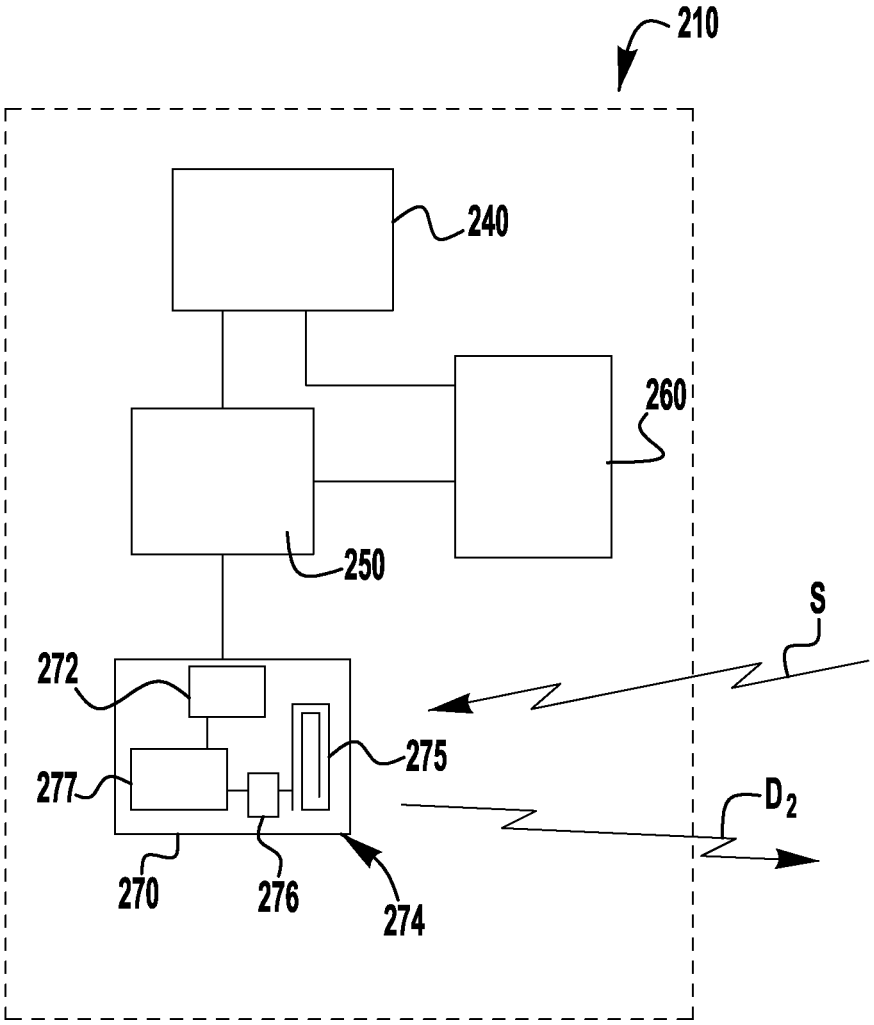
FIG. 4 is a schematic view of the activity monitor of the system of FIG. 3.

To evaluate process compliance related to usage of the hand hygiene dispenser, a monitoring system may include one or more activity monitors configured to identify the presence of an individual in an area (e.g., a room) within which the hand hygiene dispenser has been assigned, to identify opportunities for process compliant usage of a hand hygiene dispenser in that area. In the exemplary system of FIG. 2, an activity monitor 210 is positioned at an entry position 105 to the room or other area 101 in which the dispenser 10 is stationed. As shown in FIG. 4, the activity monitor 210 includes an actuator 240 (e.g., one or more motion sensors, infrared sensors, door actuated switches) powered by a power source 260 (e.g., one or more internal batteries, and/or AC mains connection) and configured to detect entry into (and/or exit from) the area 101 of one or more individuals. The actuator 240 communicates sensed activity to a controller 250. The controller is connected to an internal monitor memory 270 by a wired interface 272 to write dynamic monitor activation (or dispenser opportunity) data to the monitor memory 270. The controller 250 may also collect dynamic monitor status data from the power source 260 (e.g., low battery condition) or the actuator 240 (e.g., insufficient power to adequately operate the actuator). The controller 250, powered by the power source 260, may write this dynamic dispenser status data to the dispenser memory 270 through the wired interface 272, either concurrently with the dynamic dispenser usage data, or in a separate writing operation.

To collect monitor data from the activity monitor 210, the periodic wireless interrogation signals S, as described above, are transmitted from the external reader 190 to the activity monitor 210, which is positioned within a read range (e.g., within 30 ft) of the reader 190. The antenna portion 275 of a wireless interface 274 of the monitor memory 270 collects energy from the interrogation signals S, and the power management portion 276 of the monitor memory uses the collected energy to generate RFID data signals $D_2$ including both the dynamic monitor data written to the monitor memory 270 from the controller 250 and static monitor identification data (e.g., activity monitor serial number) for identifying the activity to the reader. When the reader 190 collects dispenser data from the dispenser 10 and monitor data from the activity monitor 210, the system 100 can identify hand hygiene compliance opportunities, as determined by activity monitor activation counts, and pair this data with corresponding hand hygiene compliance, as determined by dispenser usage counts, or failed compliance, as determined by the absence of a corresponding dispenser usage count. This collected data, when aggregated, can provide administrative information on the effectiveness of a hand hygiene compliance program (e.g., for a hospital or restaurant).

To monitor hand hygiene process compliance of specific individuals, the activity monitor 210 may include an RFID reader 280, powered (e.g., by power source 260) upon activation of the activity monitor actuator 240 to generate interrogation signals s (or alternatively, continuously powered to generate interrogation signals) for communication with an RFID identification badge B of a user U that has actuated the activity monitor 210. The RFID badge B transmits user identification data d to the reader 280, which transmits the identification data to the controller 250 for writing of the identification data to the monitor memory 270 using the wired interface 272. This identification data is transmitted by the wireless interface 274 to the external reader 190 for pairing with hand hygiene compliance data collected from the dispenser 10.

To more accurately monitor hand hygiene process compliance of specific individuals (e.g., in an area of higher traffic), the dispenser 10 may also be provided with an internal RFID reader 80, powered (e.g., by power source 60) upon activation of the dispenser actuator 40 to generate interrogation signals for communication with an RFID identification badge B of the user that has actuated the dispenser 10. The RFID badge B transmits user identification data to the reader 80, which transmits the identification data to the controller 10 for writing of the identification data to the monitor memory 70 using the wired interface 72. This identification data is transmitted by the wireless interface 74 to the external reader 190 for pairing with hand hygiene compliance data collected from the dispenser 10.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, circuits, devices and components, software, hardware, control logic, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

I claim:

1. A method for monitoring usage of an electronically operated dispenser, the method comprising:

operating a dispensing mechanism by a controller in response to activation of an actuator in communication with the controller;

wherein the dispenser includes a dual interface memory that includes a wired interface and a wireless interface;

wherein the dual interface memory is configured to receive power through the wired interface and to receive power through the wireless interface;

in response to operation of the dispensing mechanism, writing dispenser data to an internal dispenser dual interface memory in wired communication with the controller, with the controller and the dispenser dual interface memory being powered by a power source electrically connected with the controller and the dispenser memory;

receiving a wireless interrogation signal from an external reader and collecting energy from the wireless interrogation signal;

in response to receipt of the wireless interrogation signal, wirelessly transmitting the written dispenser data from the dispenser dual interface memory to the external reader, with the dispenser dual interface memory being powered by the collected energy.

2. The method of claim 1, wherein wirelessly receiving the wireless interrogation signal comprises wirelessly receiving an ultra high frequency (UHF) radio frequency identification (RFID) signal.

3. The method of claim 1, wherein wirelessly transmitting the written dispenser data comprises wirelessly transmitting an ultra high frequency (UHF) radio frequency identification (RFID) signal.

4. The method of any of claim 1, wherein operating the dispensing mechanism comprises dispensing a hand hygiene fluid.

5. The method of claim 1, wherein writing dispenser data to the internal dispenser memory comprises writing at least one of dispense count data and dispenser status data to the internal dispenser dual interface memory.

6. The method of claim 1, further comprising:

activating an activity monitor in response to user activity at a location in proximity with the activity monitor;

in response to activation of the activity monitor, writing user activity data to an internal monitor dual interface memory of the activity monitor, with the monitor dual interface memory being powered by a power source electrically connected with the activity monitor;

wirelessly receiving in the monitor dual interface memory a wireless interrogation signal from an external reader and collecting energy from the wireless interrogation signal;

in response to receipt of the wireless interrogation signal, wirelessly transmitting the written user activity data from the monitor dual interface memory to the external reader.

7. The method of claim 6, further comprising associating the written user activity data with the written dispenser data in the external reader.

8. The method of claim 6, further comprising wirelessly transmitting a wireless interrogation signal from the external reader to a radio frequency identification (RFID) badge of a user at a location proximate to one of the activity monitor and the dispenser, and receiving user identification data from the RFID badge at the external reader.

9. The method of claim 8, further comprising associating the received user identification data with the written user activity data in the external reader.

10. The method of claim 1, further comprising transmitting the written dispenser data from the external reader to a central computer system.

11. An electronically operated dispenser comprising:

a housing;

a dispensing mechanism electrically connected with a power source;

an actuator;

a controller electrically connected with the power source, the controller being in communication with the actuator and configured to operate the dispensing mechanism in response to user actuation of the actuator; and a dispenser dual interface memory including a wired interface and a wireless interface;

wherein the wired interface supports wired communication, powered by the power source, between the dispenser dual interface memory and the controller, for writing dispenser data from the controller to the dispenser memory; and wherein the wireless interface supports passive wireless communication between the dispenser dual interface memory and an external reader, for transmitting the written dispenser data from the dispenser dual interface memory to the external reader, with the dispenser data transmission being powered by energy collected from an external reader interrogation signal by the dispenser dual interface memory.

12. The dispenser of claim 11, further comprising a housing retaining the dispensing mechanism, the controller, and the dispenser dual interface memory.

13. The dispenser of claim 11, wherein the power source is disposed in the housing.

14. The dispenser of claim 11, wherein the wireless interface is configured to receive and or transmit ultra high frequency (UHF) radio frequency identification (RFID) signals.

15. The dispenser of claim 11, wherein the dispenser data comprises at least one of dispense count data and dispenser status data.

16. The dispenser of claim 11, wherein the actuator comprises at least one of an optical sensor, a motion sensor, a microphone, and a button actuated mechanism.

17. An electronically operated dispenser comprising:

a housing;

a dispensing mechanism located in the housing;

one or more batteries located in the housing for providing power to the dispenser components;

an actuator;

a controller electrically connected with the one or more batteries, the controller being in communication with the actuator and configured to operate the dispensing mechanism in response to a signal from the actuator; and a dispenser dual interface memory including a wired interface and a wireless interface;

wherein the wired interface supports wired communication, powered by the one or more batteries, to the dispenser dual interface memory; and wherein the wireless interface supports passive wireless communication between the dispenser dual interface memory and an external reader.

18. The dispenser of claim 17 further comprising a radio frequency identification device ("RFD") powered by the one or more batteries.

19. The dispenser of claim 17 further comprising a spout configured to mount to a countertop.

20. The dispenser of claim 17 wherein the dispenser is a wall mounted dispenser.

* * * * *